US005161934A

United States Patent [19]

Richardson

[11] Patent Number: 5,161,934

[45] Date of Patent: Nov. 10, 1992

[54] APPARATUS FOR HANDLING PACKAGED BOTTLES, CANS, OR THE LIKE

[75] Inventor: Edward J. Richardson, Toronto, Canada

[73] Assignee: Totall Products Ltd., Mississauga, Canada

[21] Appl. No.: 562,597

[22] Filed: Aug. 3, 1990

[30] Foreign Application Priority Data

Aug. 7, 1989 [GB] United Kingdom ..... 8918035

[51] Int. Cl.[5] ..... B66F 9/18

[52] U.S. Cl. ..... 414/621; 414/626; 294/87.1; 294/113

[58] Field of Search ..... 414/618, 621, 623, 626, 414/730, 736; 294/63.1, 67.31, 81.51, 87.1, 113

[56] References Cited

U.S. PATENT DOCUMENTS

| | | | |
|---|---|---|---|
| 3,194,422 | 7/1965 | Shinn, Jr. | 414/621 |
| 3,262,595 | 7/1966 | Seip, Jr. et al. | 414/621 |
| 4,252,496 | 2/1981 | Williams | 294/113 X |
| 4,331,320 | 5/1982 | Naruse et al. | 414/623 X |
| 4,682,931 | 7/1987 | House | 414/736 X |

FOREIGN PATENT DOCUMENTS

| | | |
|---|---|---|
| 0142420 | 5/1985 | European Pat. Off. . |
| 1489176 | 10/1977 | United Kingdom . |

*Primary Examiner*—Robert J. Spar
*Assistant Examiner*—James Keenan
*Attorney, Agent, or Firm*—Anthony Asquith & Co.

[57] ABSTRACT

The apparatus comprises a rectangular frame (20) disposed horizontally, which is fixed to the forks (25) of a lift truck. Gates (29) depend downwards from the sides of the frame, and each gate carries a pad (32). When the gates are operated hydraulically the pads clamp a pallet-sized layer (43) of cardboard cases (36) therebetween. Other layers of cases resting on the clamped layer may be picked up along with the clamped layer. The layer is clamped on all four sides, and the pads are long enough that no bottle (38) can "escape" the clamping force. The apparatus allows a high clamp force to be used, without the danger of damaging the cases or bottles.

10 Claims, 5 Drawing Sheets

APPARATUS FOR HANDLING PACKAGED BOTTLES, CANS, OR THE LIKE

This invention relates to the handling of such articles as cases or other packages containing bottles or cans.

BACKGROUND TO THE INVENTION

It is the general practice for bottles of beer to be packed in cases of twenty four bottles, arranged in four rows of six. The cases are arranged in layers, each layer comprising for example ten cases, the layers being arranged, for transport and handling, upon a pallet. Typically, the stack on the pallet may be eight layers high.

The invention is concerned with the problem that arises when pallet loads are to be broken up; for example when a layer of cases of one brand of beer has to be placed on the same pallet as a layer of cases of another brand, for shipping to the customer.

It has been the traditional practice hitherto that the task of rearranging the layers of cases on the pallets has been carried out by hand. Operators pick up the cases one by one, with their hands, from one pallet, and physically carry the cases over to another pallet. This procedure has been most uneconomical, but there has been no other way, in practice, by which the layers of cases may be moved from a stack.

The invention is concerned with a device which enables a whole layer of cases to be picked up together, and enables the layer to be carried, for example by a fork lift truck, to another pallet.

THE PRIOR ART

There have been previous attempts to provide a device that will enable the top layer of cases to be removed from a pallet load. One attempt has required the use of a slip sheet which is placed between the layers, and the use of a ram to push the layer aside. Another attempt has required that each layer of cases be placed in a tray. Such measures have not proved to be economically practical.

It has also been proposed that the cases in a layer be bound tightly together with a band that encircles the circumference of the layer; the tight binding renders the layer easier to grip. However, such a band, if left on for a prolonged period, leaves permanent damage marks on the cases: cardboard cases may recover their shape and size if distorted for a moment, but not if they undergo local concentrations of stress over a prolonged period.

An apparatus known as a carton clamp is in common use, for picking up cardboard cartons of various kinds by squeezing the cartons between jaws, and it has been proposed that layers of cases of beer bottles be picked up by such carton clamps. The problem with this approach is that the square-on positioning of the bottles within the cases is inherently unstable: so long as the cases can be clamped such that the bottles remain square-on to each other, the layer of cases retains its structural integrity, and the whole layer of cases may be lifted and carried. However, if even one bottle were to tend to slip sideways relative to its neighbours, a chain reaction effect would take place, and all the rows of bottles would suddenly slip sideways, releasing all clamping force from the jaws over the whole layer of cases, of course with disastrous results.

Another known device, which is shown in patent no EP-0142420 (VASSEUR, 22 May 1985) includes clamping-pads which squeeze and grip a layer of bottles. The patent teaches the use of vibrators on the pads, which act to consolidate the bottles together in the layer. The patent teaches that only when the layer has been consolidated by the vibrators can a squeeze force be applied to the layer, enabling the layer to be handled as a unitary body.

DESCRIPTION OF GENERAL FEATURES OF THE INVENTION

In the invention, an apparatus is provided whereby the layer of cases is picked up by clamping the layer from all four sides. The apparatus includes four clamp pads, which extend respectively along the four sides of the layer. The pads are of such dimensions that substantially every single bottle is clamped by the pads, to the extent that no bottle can "escape" the clamping effect, thereby triggering the chain reaction.

As mentioned, the pads in the apparatus extend around all four sides of the layer. Therefore, the designer cannot arrange for the pads to be manoeuvred into position in the horizontal plane; instead, in the invention, the apparatus is positioned vertically over and above the layer, with the pads set to a retracted position, and the apparatus is lowered down over the layer. The pads are then activated to squeeze the four sides of the layer.

In the invention, the pads are mounted upon a frame, the frame being of such construction as to be suitable for detachably mounting upon the carriage (or forks) of a lift truck. The mounting of the frame to the carriage is such that the frame and the carriage are constrained to move in unison; the pads are so mounted upon the frame that the pads are able to move relative to the frame, for the purpose of carrying out the said squeezing function.

It has been found, in the invention, that when the whole layer of bottles is completely contained, whereby no bottle can "escape", a clamping force of surprisingly large magnitude can be applied to the layer. Of course, the clamping force must not be so great as to damage the bottles, but it is recognized that when, and only when, the bottles are properly contained, as they are in the invention, there is a huge margin between too heavy a clamp force, which might crush the bottles, and too light a clamp force, which might permit the bottles to fall clear. The result is that with the apparatus of the invention, a layer of beer bottle cases may be picked up with a much greater degree of reliability and safety than was possible in the prior art.

In the invention, a number of layers, stacked one layer upon another, may be picked up simultaneously. Usually, only the bottom layer need actually be squeezed or clamped: the other layers simply rest upon the clamped bottom layer. It is recognized, in the invention, that the invention permits the clamping force to be set to such a large value that the weight of further layers resting upon the clamped layer is barely noticeable; and yet the magnitude of the clamp force required to achieve this is far short of a value that would damage the bottles. The key to enabling such large clamp forces to be applied to the layer, without at the same time damaging the bottles, is that the layer must be clamped on all four sides, and substantially all the bottles must be contained.

The presence of packing spacers between the bottles is an important feature of the invention. In the above mentioned EP-0142420, it was shown that a clamp force should not be applied directly to the bottles until the bottles have first been consolidated into a bottle-touching-bottle regular formation.

It is recognised that bottles are very difficult to manipulate when allowed to touch each other directly, ie glass-to-glass, because the contact between bottles is high friction, and is virtually completely without resilience. In the invention, it is recognised that the presence of packing spacers, such as the cardboard spacers usually placed between bottles of beer, provides sufficient resilience, and sufficient accommodation, to enable the layer of bottles to be consolidated, and to be forcefully clamped, all in a single simple squeeze-type operation.

It is not necessary that all the bottles should be separated by packing spacers: for example, it is acceptable, for the purposes of the invention, if a case of twenty-four bottles includes spacers which divide the bottles up into six groups of four bottles. It is however preferred that enough spacers be provided that every single bottle is held separate from all its neighbours by means of the spacers.

DETAILED DESCRIPTION OF PREFERRED EMBODIMENTS

By way of further explanation of the invention, exemplary embodiments of the invention will now be described with reference to the accompanying drawings, in which.

Figure 6A:
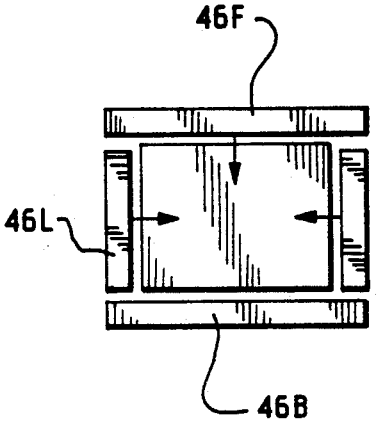
Figure 6B:
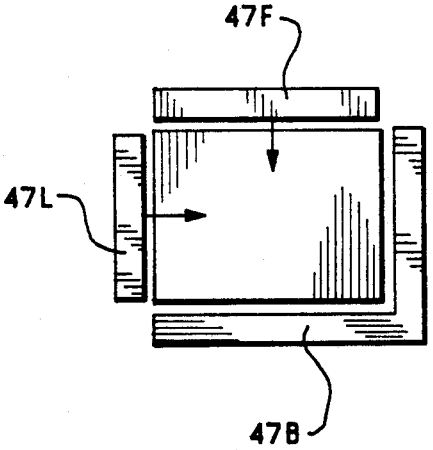
Figure 6C:
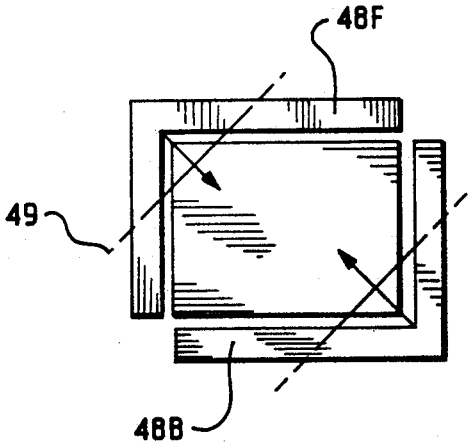

FIGS. 6A, 6B, and 6C are diagrams, in plan, of corresponding portions of alternative apparatuses.

The apparatuses shown in the accompanying drawings and described below are examples which embody the invention. It should be noted that the scope of the invention is defined by the accompanying claims, and not necessarily by features of specific embodiments.

A beer bottle case itself is made of cardboard, and usually the bottles are located and constrained within the cardboard case by means of cardboard separators placed between the bottles. For transport and handling, the cases are placed on a pallet, generally made of wood, which is provided with slots for receiving the forks of a fork lift truck. A layer of ten such cases may be laid out on the pallet. The layers of cases may be stacked, typically, up to eight high on a pallet.

Figure 1:
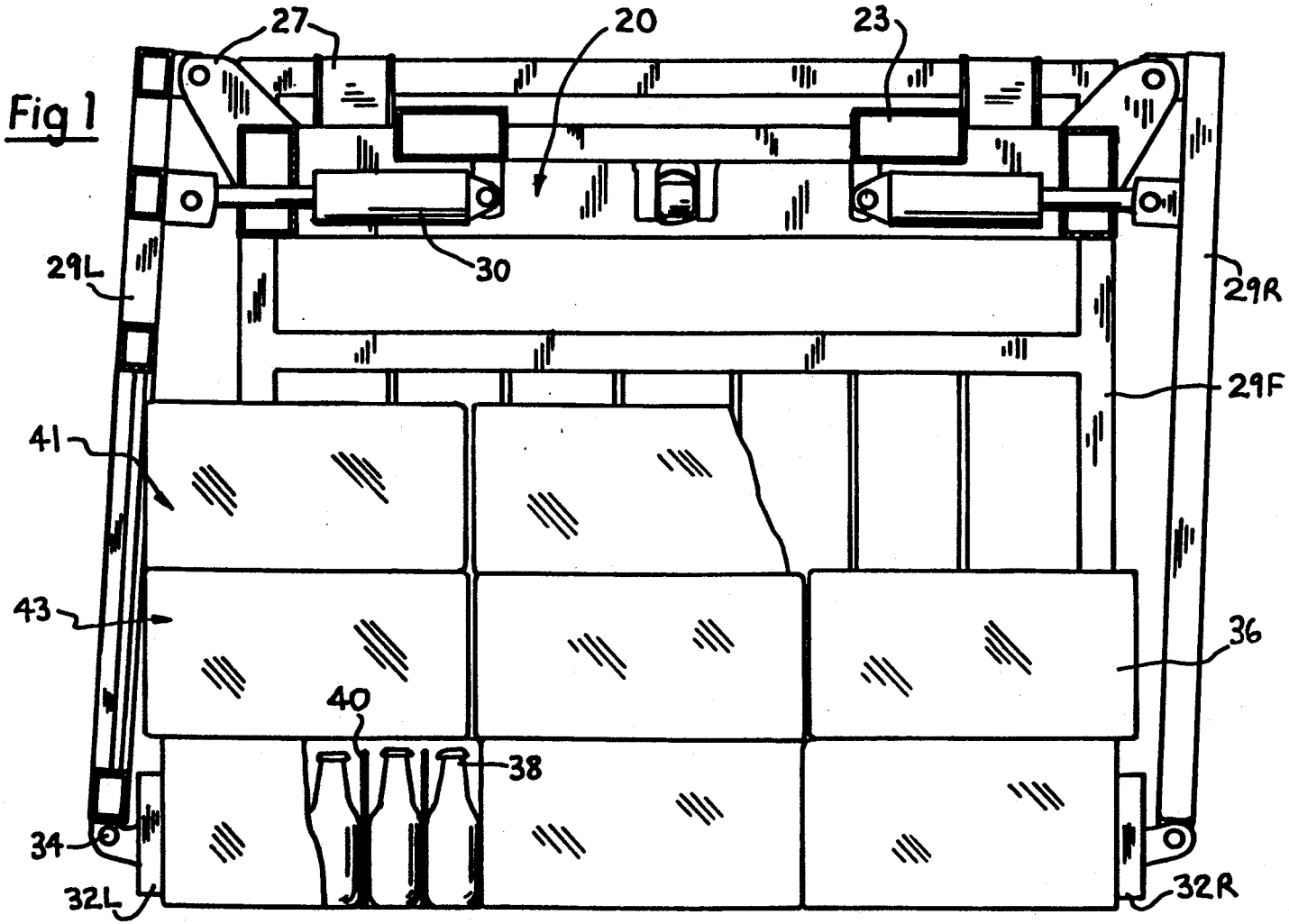
FIG. 1 is a front elevation, partly cross-sectioned, of an apparatus which embodies the invention.
Figure 2:
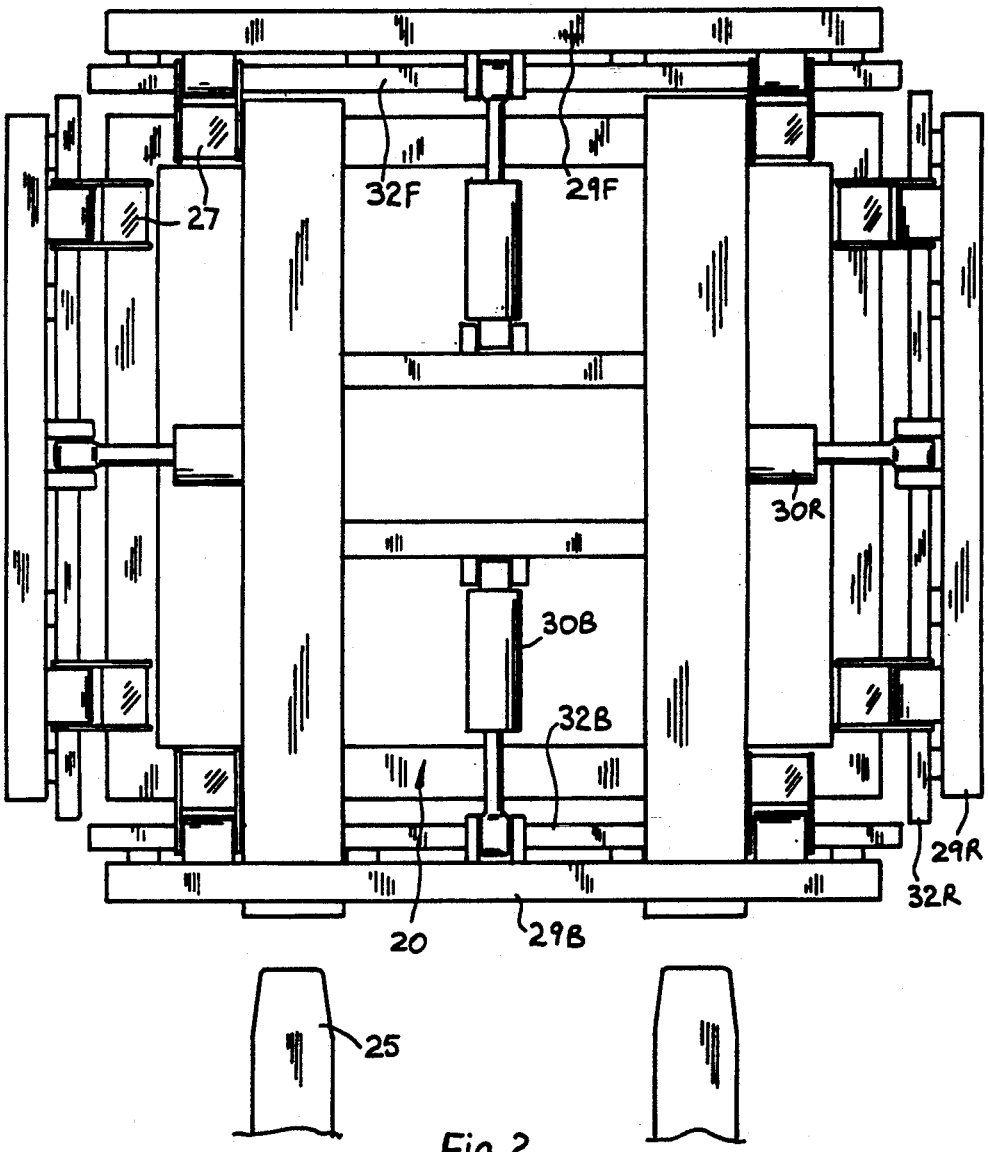
FIG. 2 is a plan view of the apparatus of FIG. 1.

The apparatus shown in FIG. 1 includes a rectangular frame 20. The frame 20 includes left and right fork pockets 23, which are adapted to receive the forks 25 which are attached to the carriage of a fork lift truck. When the forks are in the pockets, the frame may be raised and lowered in unison with the carriage, by the driver of the truck.

Protruding out from, and above, the rectangular frame 20 are pivot assemblies 27. Four gates 29 are provided, which are mounted on the pivot assemblies 27 for pivoting or hinging movement relative to the frame 20. The four gates may be termed the front 29F, back 29B, left 29L, and right 29R, gates.

(The reference letters F, B, L, and R are used in the above senses throughout this description, in combination also with other numerals. Some of the combinations are not identified in the drawings, but will be readily inferred.)

The movements of the four gates are controlled by respective hydraulic rams 30, which are attached to suitable brackets on the frame 20.

The gates 29 are provided with respective pads 32 at their lower ends. Each pad 32 may pivot about a horizontal axis 34, but is not otherwise movable relative to the respective gate 29. Springs are provided (not shown) for biassing the lower edges of the pads inwards. Also, each pad 32 protrudes inwards slightly with respect to the plane of the respective gate 29.

In operation of the apparatus, the frame 20 is assembled to the forks of the lift truck (and is locked thereto for safety). Suitable valves and connections are set up whereby the driver of the truck may control the operation of the hydraulic rams.

Figure 3A:
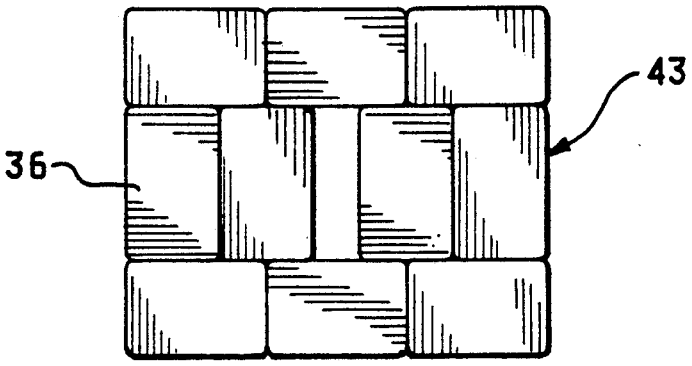
FIGS. 3A, 3B, 3C are plan views of layers of cases.

FIG. 3A shows a typical arrangement of cases of beer bottles. Each case 36 contains twenty-four bottles 38, arranged in four rows of six. The bottles are held apart from each other by cardboard separators 40, and the bottles lie "square-on" to each other; i.e. the rows are not staggered in any way.

The dimensions of a typical case of beer bottles are 40 cm long, 28 cm wide, and 20 cm high.

Figure 3B:
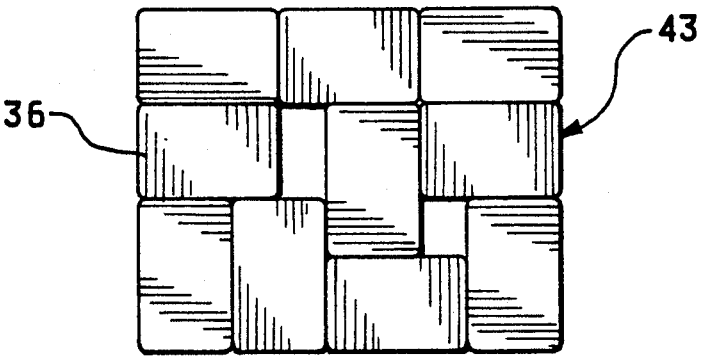
Figure 3C:
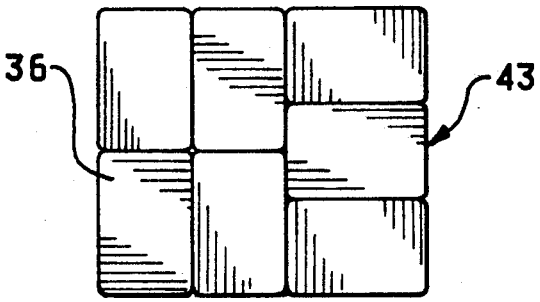

Sometimes, the cases in a layer are arranged in the pattern shown in FIG. 3B. In both the FIG. 3A and the FIG. 3B arrangements, it will be observed that there are some spaces between the cases in the interior of the layer. FIGS. 3A and 3B utilize a pallet of "large standard" size; FIG. 3C shows an arrangement of seven cases, suitable for use with a "small standard" pallet.

Figure 4A:
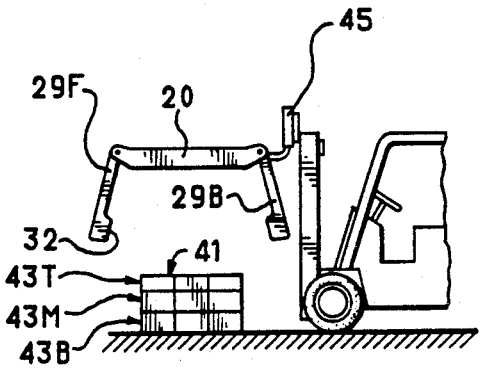
FIGS. 4A, 4B, 4C, 4D, are diagrams showing a sequence of operations of the apparatus of FIG. 1.

As a preliminary to the use of the apparatus, the stack 41 of three layers 43 of cases 36 has been placed on the ground (FIG. 4A) and the requirement has arisen of placing the top two layers in a different location from the bottom layer 43B.

The driver raises the carriage 45 of the truck, together with the frame 20, until the pads 32 are clear of the top layer 43T. He positions the frame over the stack 41 and, with the pads 32 retracted outwards, he lowers the carriage.

Figure 4B:
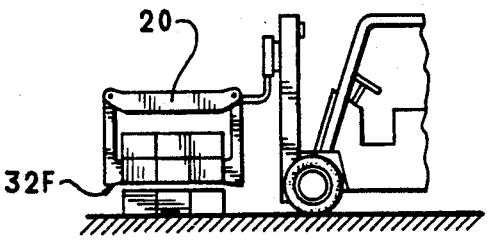

The driver stops the carriage at the appropriate point to pick up two layers, and operates the hydraulic rams 30 to clamp the pads onto the middle layer 43M. When the middle layer has been securely clamped, he raises the carriage, whereby the middle layer and the top layer 43T are raised, and the bottom layer 43B is left on the ground (FIG. 4B).

Figure 4C:
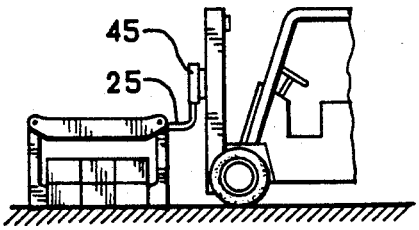
Figure 4D:
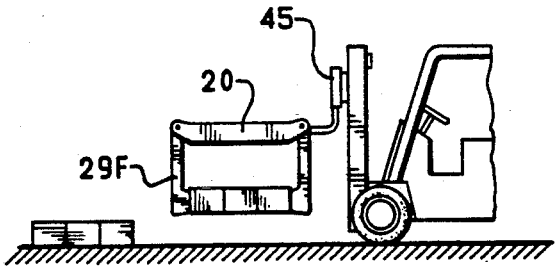

FIG. 4C shows the middle and top layers being deposited at a new location. In FIG. 4D, these two layers have been further split and separated. It will be appreciated that the stack of layers of cases may be split up and recombined in any number of ways, as required.

In the invention, it is recognized that a number of factors may affect the reliability with which the layer is picked up. These may be discussed as follows.

(a) As has been illustrated in FIG. 1, it will be observed, sometimes the frame 20 might not lie exactly symmetrically above the layer 43. This may occur if the truck is slightly off-centre when it is driven at the stack. The truck should preferably be of the "side-shift" kind, in which the carriage can be traversed sideways, to avoid the need for pinpoint accuracy in aiming the truck at the stack, but even so it can happen that the frame is a little off-centre with respect to the layer. Similarly, the front and back pads 32F, 32B might not lie with the layer exactly central between them.

(b) When the driver of the truck is careful, he can use his skill and judgement to avoid disturbing or sometimes even damaging the cases and bottles. Some truck drivers, however, approach the task more casually and it is therefore advisable to incorporate an automatic means for controlling the manner in which the pads clamp the layers.

(c) The dimensions of the cases are such that the bottles are not packed tightly in the cases, and it is recognized that consequently the layer should be pre-compressed—in order to square-up and tighten-up the layer—before applying the full clamping forces.

(d) In case the truck driver is too casual, preferably the value of the force with which the pads clamp the cases should be outside the driver's direct control. If the clamp force were too large, the bottles would be broken or the cases damaged; if the clamp force were too small, the layer of cases might fall. It is recognized in the invention that if care is taken in the design of the apparatus, there can be a large margin between the permissible extremes of the clamping force, but even so if the driver were able to control the clamp force himself, mishaps might occur.

(e) It is preferred that the number of controls be at a minimum; preferably, the driver should be provided with just a single control for the purpose of activating the clamp function. Also, when the apparatus is to be detachable from the truck, a hydraulic release-coupling is required, and it is also preferred to keep the number of these to a minimum.

The hydraulic system incorporated into the apparatus of FIG. 1, for actuating the gates and the pads, reflects the above requirements. A series of stops and sequencing valves are provided, for the purpose of controlling the manner in which the clamp force is applied to the cases constituting the layer, as will now be described.

First, the driver positions the truck so that the frame 20 lies as closely as his skill and application permit to being directly above the layer 43: as regards both the bodily position and the angular position of the frame. Now, the driver lowers the frame, by lowering the carriage of the truck, to the height of the layer.

He now activates the clamping control. The clamping system is so arranged that, upon activation, first the back pad 29B moves inwards into light contact with the layer: as the pressure builds up in the ram 30B, indicating that the pad has made contact with the layer, the increased pressure is used as a signal to actuate the ram 30F, which causes the front pad 32F also to move inwards, so that the layer 43 is being gently squeezed between the front and rear pads.

When the pressure in the ram 30F has also built up, a sequence signal is sent to the left and right rams, which now act in a similar fashion to gently squeeze the layer between the left and right pads. When there is pressure in all four rams, indicating that the layer has been squared up and tightened up, the full clamp force may be applied.

It is desired to squeeze the layer gently and progressively at first, in case some of the bottles are misaligned. Once the layer has been gently squeezed from all sides, and the bottles are all firmly in engagement with their neighbours, the full clamp force may be applied.

It is important to provide stops to limit the movement of the pads and gates, as will now be discussed.

Sometimes, the driver will position the truck closely to the ideal, central, straight, condition, such that the four pads 32, in picking up the layer, move through equal distances, and the layer is just compressed, and not moved bodily. If such accuracy could be relied on, the designer would not need to take care over providing travel limit stops. But if there were no stops to limit the travel of the pads, and if the driver were to position the frame too far off-centre, the pick-up layer might tend, when raised, to swing like a pendulum to the central position.

The clamping arrangement is such that, if the driver does position the frame further than a small margin off centre, the gates do not swing over, but rather, by the action of travel stops on the gates, the gates drag the layer bodily to a more central position with respect to the frame, before the layer can be picked up. A good driver will allow this to happen only rarely: but if the driver repeatedly positions the frame off-centre to such an extent that the dragging action damages the cases, at least this fact will be apparent and may be corrected.

Figure 5:
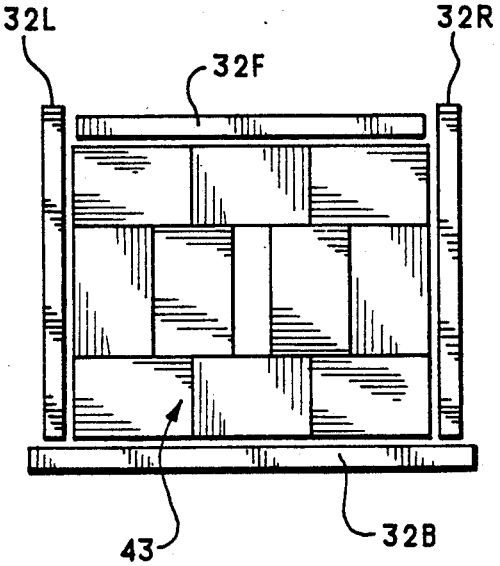
FIG. 5 is a diagrammatic representation, in plan, of a portion of the apparatus of FIG. 1.

A preferred form of the stops is illustrated diagrammatically in FIG. 5. As may be seen, the back pad 32B protrudes slightly beyond the left and right pads, whereas the front pad 32F fits, with clearance, between the left and right pads. Under the sequencing control, as described, the back pad 32B moves first, and therefore the back pad will advance until it contacts the back ends of the left and right pads 32L, 32R. The left and right pads act as travel stops, to limit movement of the back pad. The effect is that the layer will be dragged bodily to the position in which the back pad lies in contact with the left and right pads, and only the front pad 32F will "float", to equalize the clamp force front to back.

Similarly, if the frame has been positioned too far off centre in the left/right sense, say to the left, the left pad 32L will contact the left end of the front pad 32F, and from then on the right pad 32R will drag the layer over until the layer lies more centrally, and in contact with both left and right pads.

Thus, the travel stops and hydraulic sequencing system combine to ensure that the layer cannot be picked up until the layer lies centrally with respect to the frame, and to ensure that the layer is gently tightened up and straightened up prior to being clamped and lifted.

Although the travel stops have been illustrated as being embodied in the dimensions of the pads, the travel stops may in fact be incorporated into the hydraulic rams, or elsewhere in the paths of movement of the gates.

The height of the pads 32 is such that the pads touch only the layer of cases actually being clamped. Thus, if say three layers are being picked up, only the bottom layer of the three is gripped and clamped, the other two layers then resting on the clamped, picked-up layer.

If the pads were to be taller, such that the pads could grip and clamp the other layers also, the disadvantage would arise that the clamp force would have to be adjusted in accordance with the number of layers. It is recognized in the invention that when the pads are only one layer high, such that only one layer is actually gripped, the clamp force that it is convenient to apply to that one layer is ample to allow at least three more layers to rest on top of the clamped layer, their weight being supported purely by the gripping action applied to the picked-up layer. Therefore, the truck driver is spared the task of having to adjust the hydraulic pressure. That task, however, is not all that onerous, and, as will be described below, is sometimes to be preferred.

Providing the layer is gripped from all four sides, and is gripped in such a way that substantially no bottle can "escape" from the grip, and providing the clamping is applied in such a way that the layer is constrained by the gripping pads to remain rectangular, then it is recognized in the invention that there is an enormous margin between applying too little clamp force, whereby the cases would fall out, and too much force, which would damage the cases or the bottles. Even with three extra layers of cases being supported, the gripped layer can easily be subject to a sufficiently high clamping force that the picked-up layers are stable and secure, to a high margin of safety: to the extent that several more layers could, as far as weight is concerned, be supported.

At the same time, the magnitude of the clamp force required to achieve this high degree of security is far short of a clamp force that would cause damage: preferably, as mentioned, the bottles have previously been tightened up and squared up, to ensure that the bottles are prepared and ready for the large force to be applied.

The upper layers resting on the clamped layer, which are to be picked up in unison with the clamped layer, are not compressed, whereas the length and width of the clamped layer are measurably reduced by the action of clamping that layer. This squeezing of the clamped layer causes no damage to the cardboard cases, providing the bottles in the layer have been gently tightened up and squared up prior to clamping, but it does mean that the unclamped upper layers therefore protrude slightly beyond the edges of the clamped layer, which is one reason for mounting all four of the pads on respective retractable gates, as will now be explained. FIG. 6A shows diagrammatically an arrangement of pads 46 wherein the back pad 46B is not movable relative to the frame. The left, right, and front pads are actuated by means of respective hydraulic rams. A potential problem might arise with this arrangement that when the clamped layer is released, the back pad remains touching the layer. The clamped (bottom) layer has, however, been dimensionally compressed by the clamping action, and therefore the layers above, which have not been compressed, may protrude a small distance outwards beyond the clamped layer. If the back pad cannot be retracted, as it cannot in the FIG. 6A arrangement, then, when the carriage is raised, the back pad will scrape up the back side of the cases in the layers above. To avoid this, in FIG. 6A the driver would have to manoeuvre the truck until the back pad is clear, before he raises the carriage.

However, it should also be stated that in practice a difficulty can arise in the case where all four pads are retractable, as will now be described.

Theoretically, where all four pads are retractable, when the bottom layer of cases is released, and the apparatus is raised upwards, all the pads are moved well clear of the cases in the layers above (as mentioned, the cases in the layers above may be protruding slightly beyond the outline of the cases of the clamped lower layer). Having all four pads retractable theoretically allows plenty of margin for the driver to lower the apparatus down over the layers, with the pads well clear, and later to raise the apparatus.

It is, however, a common reaction on the part of the truck driver, after he has lowered the apparatus into position on the layer, in fact to inch the truck forward until the back pad is in contact with the layer. Only when the back pad is touching the layer does he activate the rams. The problem then arises, when releasing the apparatus, that the driver does not reverse the truck a corresponding distance, perhaps not realising that he has used up all the retraction movement of the back pad. Therefore, the back pad grazes the layers above when the apparatus is raised.

Drivers have to be specially instructed about this problem. The natural tendency of the skilled driver is to use his skill to inch the truck forwards until the back pad just touches the layer: this is a common truck-driving requirement with many kinds of loads.

The arrangement shown in FIG. 6A helps to alleviate this problem. In FIG. 6A, the back pad is not movable, i.e. the back pad is fixed relative to the frame of the apparatus. (The rest of the apparatus is as described above.) The truck drive must, before lowering the pads, position the truck so that the back pad is well clear of the layer. Then, when the pad has been lowered into position with respect to the layer, he must inch the truck forwards until the back pad touches the layer. Later, when he comes to release the layer, because he knows the back pad is fixed, the driver knows he must back up the truck a corresponding distance, in order to avoid grazing the layers above when the pads are raised.

Another benefit is attributable to the FIG. 6A arrangement, in that the front pad 46F does not, as might have been expected, need to be given double the range of movement, to compensate for the loss of movement of the back pad 46B. Rather, it may be regarded that the inching movement of the truck takes the place of the movement of the back pad.

As a general rule, to ensure that the front and back pads can maintain their clamp force, the lengths of the left and right side pads 46L, 46R must be somewhat shorter than the nominal width of the layer, both to compensate for the contraction of the layer when the clamp force is applied, and in case the layer is somewhat narrower than the nominal width (within a tolerance band). When the layer is larger than the nominal width, consequently there might be a substantial gap between the ends of the side pads and the front and back pads.

When the back pad does not move, i.e. when the movement of the back pad is replaced by movement of the truck, as in FIG. 6A, this gap may be reduced. The movement of the truck not only replaces the movement of the pad, but also eliminates the need for fifty percent of the gap. Where all four pads move, as in FIG. 1, the needed gap can sometimes be as large as one bottle width. As has been pointed out, it is recognized in the invention that substantially none of the bottles should be allowed to "escape" the applied clamp forces from all four directions and whilst a gap of just one bottle will probably not matter, any greater gap than that could be critical. The FIG. 6A arrangement permits the gap to be smaller than the corresponding gap when all four pads move.

The FIG. 6B arrangement, in which both the back pad 47B and the right pad 47R cannot be retracted relative to the frame, is less preferred, but is within the scope of the invention. A skilled truck driver can position a truck within a lateral tolerance of about 5 cm, and the truck may be of the kind that is equipped with lateral or side-shift movement of the carriage; but it can be tiresome for the driver to ensure that the available travel of the side-shift mechanism lies to the left (FIG. 6B) before clamping commences. When the sideways clamping movement is accomplished by the movement of both the side pads relative to the frame, this does not arise.

In another arrangement, as shown in FIG. 6C, the pads may be arranged to move in a diagonal direction. The left pad 48L is unitary with the front pad 48F and the right pad 48R is unitary with the back pad 48B. The axes about which the pads are pivoted are shown at 49. While in FIG. 6C the pads may be automatically retracted far enough to avoid scraping the sides of cases in the layers above, the FIG. 6C arrangement is not preferred over FIG. 1 because the facility to gradually and progressively square-up the layer is less available in FIG. 6C than in FIG. 1.

In the preferred arrangement of FIG. 1, the cases in the upper layers are simply resting upon the lower layer: railings are therefore provided in the gates to restrain the cases in the upper layers against being dislodged during motion of the truck.

In the arrangements illustrated, the pads have been attached to gates, and the gates have been pivoted to the frame. It is contemplated in the invention that the gates may be fixed relative to the frame, and the pads may then be actuable by means of rams positioned between the pads and the fixed gates. This arrangement is less preferred because the rams would then take up undue space at a place where space is at a premium.

As mentioned, it is important that the bottles in the layer be properly squared-up, and tightened-up into contact with each other, before the final, heavy clamp force is applied. It has been found to be important, in achieving the proper pre-manipulation of the layer, that the pads be constrained to remain at right angles to each other throughout the pre-manipulation phase. Thus, the gates should be so mounted to the frame that the gates remain always at right angles to each other throughout their range of movement, and each pad should be similarly constrained to remain parallel to its gate.

The invention has been described as it relates to cases of beer bottles. The invention may also be used in relation to cases of canned goods, for example. However, a layer of cases of bottles is somewhat more rigid than a corresponding layer of cases of cans, and the slightly greater "give" of the cases of cans, when squeezed, reduces slightly the safety margin between the permitted extremes of the clamp force.

It is the practice to place cans of beer in cardboard trays ("mother" trays); typically, the cans are arranged on the tray in four rows of six cans. Mother trays often have a circumferential lip extending partway up the height of the cans. When a layer of mother trays is compressed, it will be understood that most of the clamp force is transmitted through the bases of the cans, and indeed the tops of the cans in a tray may separate slightly from each other—due to the presence of the cardboard lip, which concentrates all the clamp force to the bottoms of the cans. The effect is that a layer of trays of cans might have a greater tendency to sag in the centre of the clamped layer than a corresponding clamped layer of cases of bottles.

This tendency may be compensated, at least partially, by applying a heavier clamping force: whilst cans are not so rigid as bottles, they do have considerable strength to resist clamping forces applied in the plane of the bottoms of the cans, and, as has been mentioned previously, it is recognized that clamping from all four sides, as in the invention, permits a surprisingly large clamp force to be applied reliably and safely.

It may be preferable, possibly more so with trays of cans than with cases of bottles, for the designer to elongate the pads vertically, whereby the clamp force may then be applied to all the layers to be picked up, not just to the bottom layer. In this case, it would be preferable to have the truck driver select a higher pressure for the clamp force when he is picking up more than one layer. Alternatively, instead of making the pads taller, the designer may arrange that another set of four pads be provided, positioned above the main set of the pads as described. These extra pads would be brought into operation as required in the event that more than one layer is to be lifted.

Complications such as extra pads or selecting different pressures should be avoided if possible, however, but are contemplated within the scope of the invention.

The apparatus described may also be used with cases of empty beer bottles. The cardboard cases of empty bottles often have no top, so that cases in the layer above may lie at slightly different levels from neighbouring cases in that layer, but this has been found not to matter in the invention.

It may be noted that when a picked-up layer of cases, perhaps with the weight of several layers resting upon it, is being put down, the weight of the layers of course rests upon the bottom layer: and the weight also of the heavy carriage itself of the lift truck rests on the clamped layer, after the layer has been put down, but before the clamp force is released. These combined weights clearly are considerable, and yet, as is recognised in the invention, the high resistance of glass bottles to being distorted means that these forces can be effectively fed into the layer, and distributed through enough of the bottles in the layer that no bottle ever becomes over-stressed.

I claim:

1. Apparatus for handling cylindrical containers, in combination with a layer of the containers, wherein:

the containers are of a cylindrical configuration, having an axis of cylindricity;

the layer includes many of the containers, and includes packing spacers;

the many containers are arranged, axes upright, in regular rows;

the packing spacers are located between the containers, in such a manner that at least some of the containers are spaced and held apart from adjacent containers by the presence therebetween of a respective packing spacer;

the apparatus includes a frame;

the apparatus includes an attachment means which is suitable for attaching the frame to the carriage of a fork lift truck, the truck being of the kind having a raisable carriage and having a lift mast;

the attachment means is so arranged that, when the apparatus is attached to the fork lift truck, the frame is attached to the carriage and is movable up and down the lift mast of the truck, but the frame is constrained against all other modes of movement relative to the truck;

the apparatus is suitable for lifting the said layer;

the circumference of the layer is rectangular in plan view, having front, back, left, and right, side edges;

the apparatus includes front, back, left, and right pads;

the apparatus includes a movable front gate, left gate, and right gate;

the apparatus includes left and right gate pivot mount means, upon which the left gate and the right gate are mounted for pivoting movement relative to the frame, and which is so arranged that the left gate and the right gate depend downwardly from the frame;

the left pad and the right pad are operatively attached respectively to the left gate and the right gate;

the apparatus includes a means for constraining the back pad against bodily movement of the back pad relative to the frame in a direction towards and away from the front pad;

the apparatus includes a front gate pivot mount means, upon which the front gate is mounted for pivoting movement relative to the frame, and which is so arranged that the front gate depends downwardly from the frame;

the left and right gate pivot mount means are so arranged that the left and right gates are pivotable with respect to the frame for operative relative clamping movement of the left and right pads in a left-right sense;

the front gate pivot mount means is so arranged that the front gate is pivotable with respect to the frame for operative clamping movement of the front pad relative to the back pad in a front-back sense;

the apparatus includes means for operating the gates and pads in the said clamping movements;

the left and right pads are arranged for operative contact respectively with the left and right side edges of the layer and the left and right gate pivot mount means and the means for operating the pads and gates are so arranged that, when operated, the left pad and the right pad clamp the layer between them in the left-right sense;

the front and back pads are arranged for operative contact respectively with the front and back side edges of the layer, and the front gate pivot mount means and the means for operating the front gate and pad are so arranged that, when operated, the front pad and the back pad clamp the layer between them in the front-back sense;

and each pad is so dimensioned as to apply clamp force to substantially all the containers lying along the full length of the respective side edges of the layer;

the front pad and the back pad are so dimensioned as to extend beyond the left and right side edges of the layer;

and the left and right pads are so dimensioned as to be free to move towards each other, and to clamp the layer, between the front and back pads, and without constraint from the front and back pads when the front and back pads are clamped to the layer.

2. Combination of claim 1, wherein the layer includes a plurality of cardboard cases, each of rectangular configuration, and arranged in side-by-side direct contact, a plurality of bottles and the packing spacers being within the cases.

3. Combination of claim 2, wherein the packing spacers are of cardboard.

4. Combination of claim 3, wherein the containers are glass bottles.

5. Combination of claim 1, wherein the direction of the said operative movement of the pads is substantially horizontal.

6. Combination of claim 1, wherein the manner of attaching the pads to the gates, and the manner of pivoting the gates to the frame is such that the pads are constrained to remain mutually at right angles throughout the range of the said operative movement of the pads relative to the frame.

7. Combination of claim 1, wherein the pads are operated by respective hydraulic rams.

8. Combination of claim 6, wherein the apparatus is so dimensioned that the height of the frame above the pads is sufficient that at least one further layer of the containers, in addition to the said layer that is squeezed between the pads, and resting on top of the said layer, can be accommodated between the said layer and the frame.

9. Combination of claim 8, wherein the pads are so dimensioned and arranged that, when the said layer is being squeezed by the pads, the pads are not in contact with the further layer.

10. Combination of claim 1, wherein the packing spacers are located between the containers in such a manner that substantially none of the containers in the layer are in direct contact with each other.

* * * * *